US007992855B2

(12) United States Patent
Awano

(10) Patent No.: US 7,992,855 B2
(45) Date of Patent: Aug. 9, 2011

(54) RECORDING MEDIUM POST-PROCESSING APPARATUS, IMAGE FORMING SYSTEM AND POST-PROCESSING METHOD

(75) Inventor: Hiroaki Awano, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 556 days.

(21) Appl. No.: 12/107,805

(22) Filed: Apr. 23, 2008

(65) Prior Publication Data

US 2009/0121408 A1 May 14, 2009

(30) Foreign Application Priority Data

Nov. 13, 2007 (JP) ..... 2007-294818

(51) Int. Cl.
*B65H 37/04* (2006.01)

(52) U.S. Cl. ..... 270/58.08; 270/58.07; 270/58.11

(58) Field of Classification Search ..... 270/20.1, 270/32, 37, 45, 51, 58.07, 58.08, 58.09, 58.11, 270/58.12, 58.17, 58.27; 412/18, 33
See application file for complete search history.

(56) References Cited

U.S. PATENT DOCUMENTS 6,231,039 B1 * 5/2001 Chung ..... 270/58.01
6,450,934 B1 * 9/2002 Coombs ..... 493/383
6,517,065 B2 * 2/2003 Miyake et al. ..... 270/58.09
7,077,393 B2 * 7/2006 Ishida ..... 270/37
2006/0038336 A1 * 2/2006 Hirata et al. ..... 270/37
2006/0078363 A1 * 4/2006 Terao et al. ..... 399/407
2007/0235917 A1 * 10/2007 Nagasako et al. ..... 270/58.08

FOREIGN PATENT DOCUMENTS

JP 3-577894 B2 7/2004
JP 2004-277036 A 10/2004
JP 2004-277037 A 10/2004
JP 2004-277038 A 10/2004
JP 2004-277069 A 10/2004

* cited by examiner

*Primary Examiner* — Leslie A Nicholson, III
(74) *Attorney, Agent, or Firm* — Sughrue Mion, PLLC

(57) ABSTRACT

The recording medium post-processing apparatus is provided with: a recording-medium collecting member that collects plural recording mediums transported from outside as a recording-medium bundle; a stitching unit that stitches the recording mediums having: a supporting portion which supports the recording-medium bundle transported from the recording-medium collecting member; and a stapler portion which pushes a stitching needle into the supported recording-medium bundle; and a recording-medium bundle stacking member that is arranged below the stitching unit and stacks the recording-medium bundle stitched by the stitching unit in a vertical direction. The supporting portion and the stapler portion of the stitching unit are moved outside a position at one edge portion of the recording-medium bundle when the recording-medium bundle is not stitched.

16 Claims, 14 Drawing Sheets

RECORDING MEDIUM POST-PROCESSING APPARATUS, IMAGE FORMING SYSTEM AND POST-PROCESSING METHOD

CROSS REFERENCE TO RELATED APPLICATIONS

This application is based on and claims priority under 35 USC §119 from Japanese Patent Application No. 2007-294818 filed Nov. 13, 2007.

BACKGROUND

1. Technical Field

The present invention relates to a recording medium post-processing apparatus, an image forming system and a post-processing method.

2. Related Art

In a recording medium post-processing apparatus that performs post-processing for a recording medium on which an image is formed by an image forming apparatus such as a printer, copying machine and the like, a stitching function unit that stitches a bundle of recording mediums by a staple (a stitching needle) is mounted in general. In such a stitching function unit, plural stitching function portions that stitch different portions of the bundle of recording mediums such as an edge-stitching function portion that stitches an edge portion of the bundle of recording mediums for example, a saddle-stitching function portion that stitches a central portion of the bundle of recording mediums for example, and the like are provided. Each of the bundles of the recording mediums stitched by the different stitching function portions is transported to different recording-medium holding trays and provided to a user.

SUMMARY

According to an aspect of the invention, there is provided a recording medium post-processing apparatus including: a recording-medium collecting member that collects plural recording mediums transported from outside as a recording-medium bundle; a stitching unit that stitches the recording mediums having: a supporting portion which supports the recording-medium bundle transported from the recording-medium collecting member; and a stapler portion which pushes a stitching needle into the supported recording-medium bundle; and a recording-medium bundle stacking member that is arranged below the stitching unit and stacks the recording-medium bundle stitched by the stitching unit in a vertical direction. The supporting portion and the stapler portion of the stitching unit are moved outside a position at one edge portion of the recording-medium bundle when the recording-medium bundle is not stitched.

BRIEF DESCRIPTION OF THE DRAWINGS

Exemplary embodiment (s) of the present invention will be described in detail based on the following figures, wherein.

DETAILED DESCRIPTION

Hereinafter, exemplary embodiments of the present invention will be described in detail with reference to the accompanying drawings.

Figure 1:
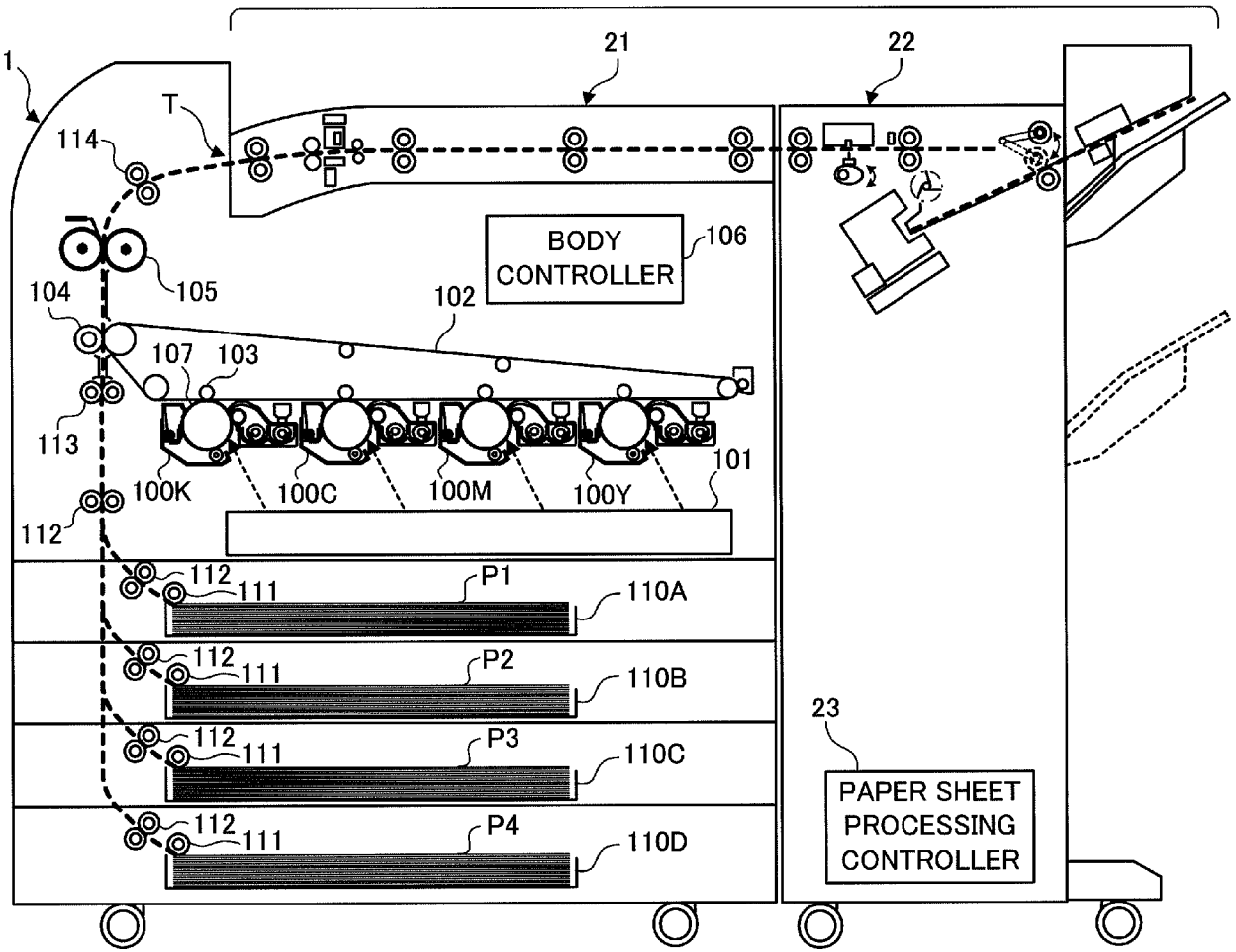
FIG. 1 is a diagram illustrating a configuration of an image forming system to which the exemplary embodiment is applied.

FIG. 1 is a diagram illustrating a configuration of an image forming system to which the exemplary embodiment is applied. The image forming system shown in FIG. 1 is configured by an image forming apparatus 1 such as a printer, a copying machine or the like that forms a color image with, for example, an electrophotographic method, and a sheet post-processing apparatus 2 as an example of a recording medium post-processing apparatus 2 that performs post-processing such as stitching of recording mediums (paper sheets, sheets) after an image is formed by the image forming apparatus 1.

The image forming apparatus 1 is configured with a so-called tandem type. Further, the image forming apparatus 1 is provided with four image forming units 100Y, 100M, 100C and 100K (also collectively referred to as "image forming units 100") that form images based on respective color image data, and a laser exposing apparatus 101 that exposes a photoconductor drum 107 provided in each of the image forming units 100.

In addition, the image forming apparatus 1 is provided with an intermediate transfer belt 102 on which respective color toner images formed in the image forming units 100 are multi-transferred, a primary transfer roll 103 that sequentially (primarily) transfers the respective color toner images formed in the image forming units 100 to the intermediate transfer belt 102, a secondary transfer roll 104 that collectively (secondarily) transfers the respective color toner images transferred on the intermediate transfer belt 102 to a recording medium (a paper sheet), a fixing apparatus 105 that fixes the respective color toner images, which is secondarily transferred, on the paper sheet, and a body controller 106 that controls operation of the image forming apparatus 1.

In each of the image forming units 100 of the image forming apparatus 1, each color toner image is formed through a process of charging the photoconductor drum 107, a process of forming an electrostatic latent image on the photoconductor drum 107 as a result of scanning and exposing the photoconductor drum 107 by the laser exposing apparatus 101, and a process of developing the electrostatic latent image formed thereon with each color toner. The respective color toner images formed in the image forming units 100 are electrostatically transferred to the intermediate transfer belt 102 by the primary transfer rolls 103 in sequence. Then, the respective color toner images are transported to a position where the secondary transfer roll 104 is arranged, according to the movement of the intermediate transfer belt 102.

In the image forming apparatus 1, plural paper sheets P1 to P4 (collectively referred to as "a paper sheet P" or "a paper sheet bundle P") that are different sizes and different kinds of paper are stored in paper sheet storing units 110A to 110D, respectively. For example, when the paper sheet P1 is designated by the body controller 106, the paper sheet P1 is taken from the paper sheet storing unit 110A by a pick-up roll 111, and then the paper sheet P1 is transported to a position where resist rolls 113 are arranged, one by one, by transporting rolls 112. The same is applied in the case where the paper sheet P2, P3 or P4 is designated by the body controller 106.

Thereafter, the paper sheet P is supplied from the resist rolls 113 in accordance with timing of transporting the respective color toner images on the intermediate transfer belt 102 to the position where the secondary transfer roll 104 is arranged. Thereby, the respective color toner images are collectively and electrostatically transferred (secondarily transferred) on the paper sheet P by action of a transfer electric field formed by the secondary transfer roll 104.

Then, the paper sheet P on which the respective color toner images are secondarily transferred is removed from the intermediate transfer belt 102, and is transported to the fixing apparatus 105. In the fixing apparatus 105, the respective color toner images are fixed on the paper sheet P by a fixing processing with heat and pressure. As a result of this, an image is formed. Thereafter, the paper sheet P on which the image is formed is discharged from a paper sheet exiting portion T of the image forming apparatus 1 by the transporting rolls 114, and is transported to the sheet post-processing apparatus 2 connected to the image forming apparatus 1.

The sheet post-processing apparatus 2 is arranged on the downstream side of the paper sheet exiting portion T of the image forming apparatus 1, and executes post-processing such as punching, stitching and the like for the paper sheet P on which the image is formed.

Figure 2:
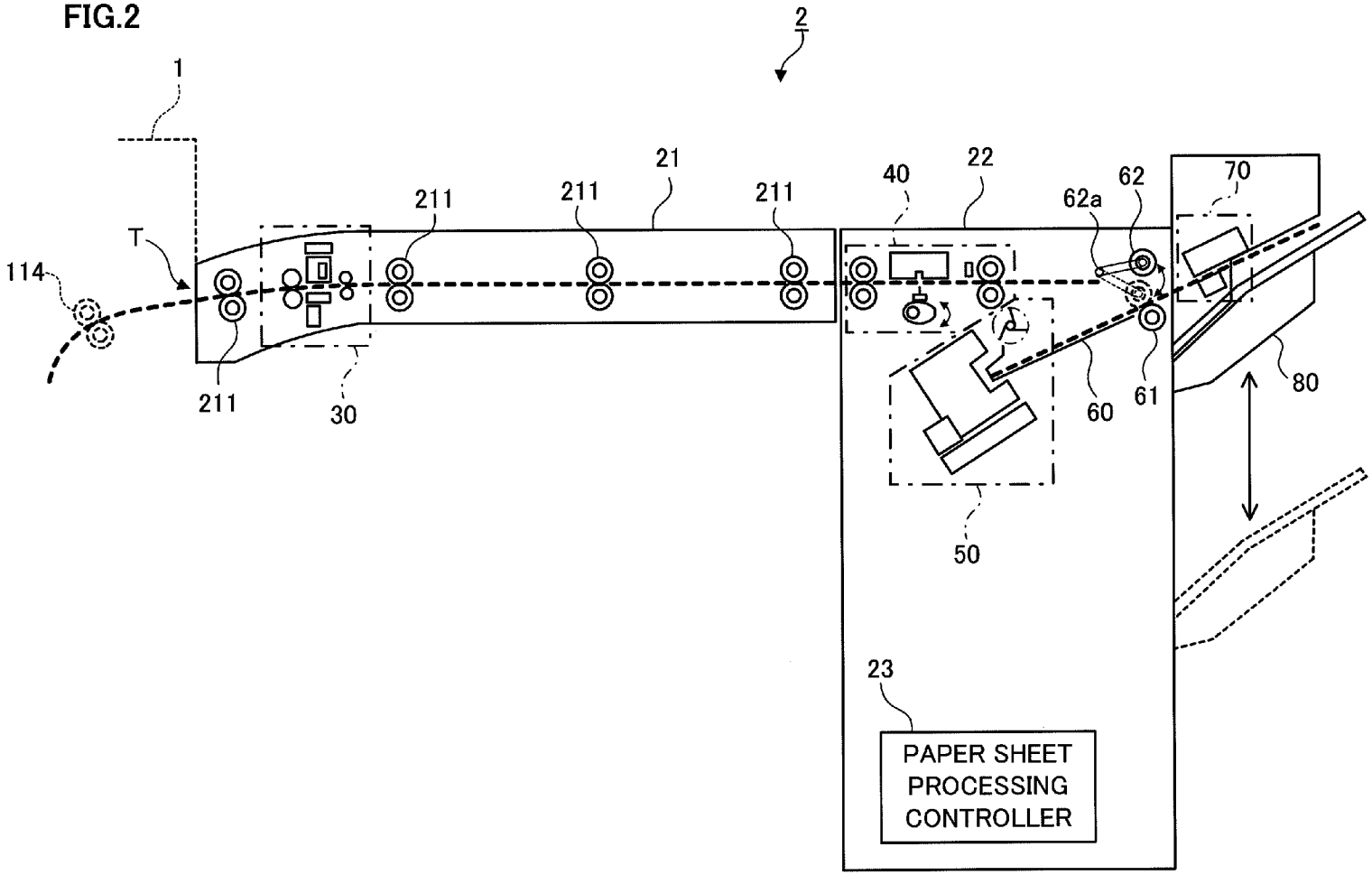
FIG. 2 is a diagram illustrating a configuration of the sheet post-processing apparatus of the exemplary embodiment.

FIG. 2 is a diagram illustrating a configuration of the sheet post-processing apparatus 2 of the exemplary embodiment. As shown in FIG. 2, the sheet post-processing apparatus 2 is provided with a transporting unit 21 that is connected to the paper sheet exiting portion T of the image forming apparatus 1, a finisher unit 22 that performs certain post-processing for the paper sheet P taken into the transporting unit 21, and a paper sheet processing controller 23 that controls respective mechanical units of the sheet post-processing apparatus 2. The paper sheet processing controller 23 is connected to the body controller 106 via a signal line (not illustrated in the figure), and transmits and receives a controlling signal and the like to and from the body controller 106. It should be noted that, in the sheet post-processing apparatus 2 in FIG. 1, the paper sheet processing controller 23 is arranged inside a housing of the finisher unit 22. However, the paper sheet processing controller 23 may be arranged inside a chassis of the image forming apparatus 1. Moreover, the body controller 106 of the image forming apparatus 1 may be configured to have a controlling function of the paper sheet processing controller 23.

The transporting unit 21 of the sheet post-processing apparatus 2 is provided with a punching function unit 30 that punches holes such as two holes and four holes, and plural transporting rolls 211 that transport a paper sheet P on which an image has been formed in the image forming apparatus 1, to the finisher unit 22.

On the other hand, the finisher unit 22 is provided with a folding function portion 40 that forms a fold at the central portion of the paper sheet P, a compiling tray 60 as an example of a recording-medium collecting member that collects a necessary number of paper sheets P and produces a paper sheet bundle P, an edge stitching staple function portion 50 as an example of a stitching unit that executes staple-stitching (edge stitching) for an edge of the paper sheet bundle P, a saddle-stitching staple function portion 70 as an example of a stitching unit that executes staple-stitching (saddle-stitching) for a central portion of the paper sheet bundle P where the fold is formed by the folding function portion 40, and a stacker tray 80 that is an example of a recording-medium bundle stacking member that holds a paper sheet bundles P and moves in a vertical direction according to an amount of the held paper sheet bundles P.

Further, the finisher unit 22 is provided with a exit roll 61 that discharges the paper sheet bundles P collected on the compiling tray 60, and a movable roll 62 that moves to a position so as to retract from the exit roll 61 when the paper sheet P is collected on the compiling tray 60 and that moves to a position so as to be brought into contact with the exit roll 61 with pressure when the paper sheet P is transported out of the compiling tray 60, with a rotation axis 62*a* as the center of the movement.

A description is given for the post-processing of a paper sheet P performed in the sheet post-processing apparatus 2.

The sheet post-processing apparatus 2 executes various kinds of post-processing for a paper sheet P as a result of outputting, from the body controller 106 to the paper sheet processing controller 23, an instruction signal for executing post-processing for the paper sheet P on which an image has been formed in the image forming apparatus 1. Here, a description is given in the case where an instruction signal for executing post-processing for a paper sheet P is outputted from the body controller 106.

First, a paper sheet P on which an image has been formed in the image forming apparatus 1 is transported to the transporting unit 21 of the sheet post-processing apparatus 2. In the transporting unit 21, the punching function unit 30 punches the paper sheet P according to an indication signal from the paper sheet processing controller 23, and then the paper sheet P is transported to the finisher unit 22 by the transporting rolls 211. It should be noted that, in the case of no indication of punching a paper sheet P from the paper sheet processing controller 23, the paper sheet P is not subjected to the punching processing by the punching function unit 30, and is transported to the finisher unit 22 by the transporting rolls 211 as it is.

When the paper sheet P is transported to the finisher unit 22, in the case where an instruction signal for instructing saddle-stitching has been transmitted from the paper sheet processing controller 23, a fold is formed at the central portion of the paper sheet P in the folding function portion 40. In the case where the saddle-stitching instruction has not been transmitted from the paper sheet processing controller 23, the fold forming processing is not performed by the folding function portion 40 and the paper sheet P passes through the folding function portion 40 as it is.

Figure 3A:
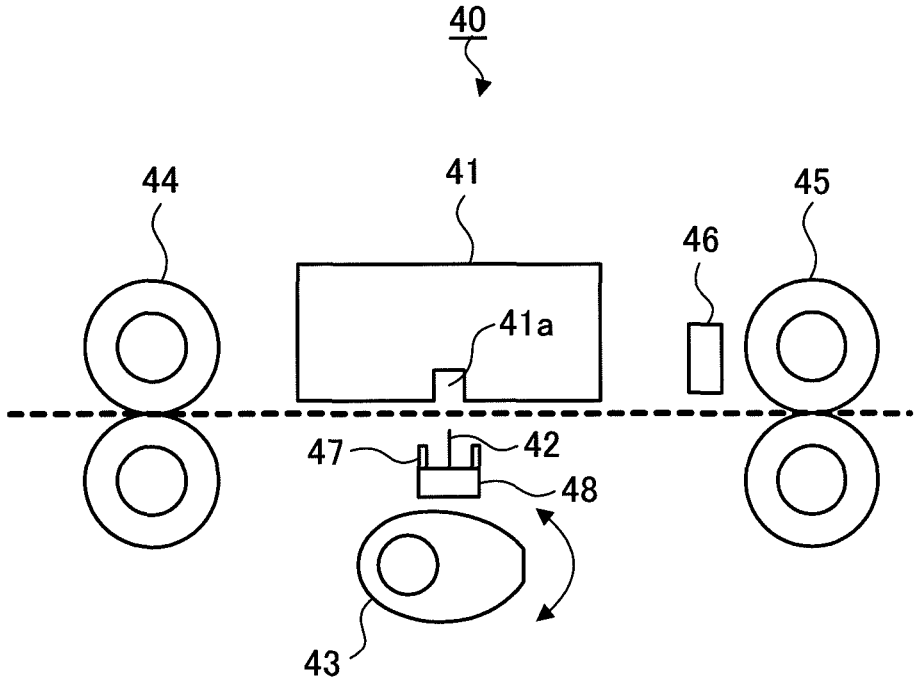
FIGS. 3A to 3C are diagrams for explaining the folding function portion.
Figure 3B:
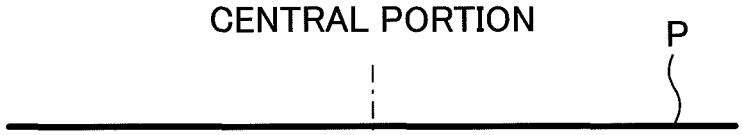
Figure 3C:
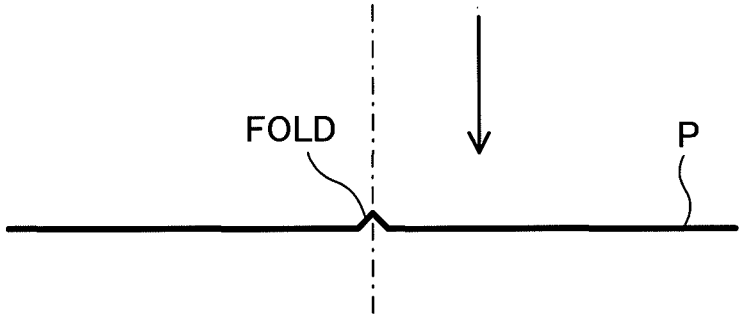

Here, FIGS. 3A to 3C are diagrams for explaining the folding function portion 40. FIG. 3A is a diagram for explaining a configuration of the folding function portion 40, FIG. 3B is a diagram for explaining the paper sheet P before the fold is formed at the central portion, and FIG. 3C is a diagram for explaining the paper sheet P in which the fold is formed at the central portion.

The folding function portion 40 is provided with a fold base portion 41 on which a groove portion 41*a* is formed along a direction orthogonal to a transporting direction of the paper sheet P, a fold blade 42 that is arranged so as to be opposed to the groove portion 41*a* on the lower side of the fold base portion 41 and moves so as to project toward the groove portion 41*a* from the lower side, a paper sheet fixing member 47 that presses and fixes the paper sheet P onto the fold base portion 41 in the front and rear in the transporting direction of the paper sheet P of the fold blade 42, a holder 48 that supports the fold blade 42 and the paper sheet fixing member 47, and a cam 43 that moves the holder 48 in the vertical direction. Moreover, the folding function portion 40 is provided with a transporting rolls 44 and a transporting rolls 45 that transport the paper sheet P and fix both edge portions of the paper sheet P in the transporting direction when the fold is formed on the paper sheet P, and a paper sheet sensor 46 that detects timing when a front edge of the paper sheet P passes.

In the folding function portion 40, when the paper sheet P is transported from the transporting unit 21, the transporting rolls 44 and the transporting rolls 45 transport the paper sheet P. During that time, the paper sheet sensor 46 detects a front edge portion of the paper sheet P and notifies the paper sheet processing controller 23 of passage timing of the front edge portion of the paper sheet P. In this case, the paper sheet processing controller 23 has been notified of information on the size of the paper sheet P that has been transported to the sheet post-processing apparatus 2, by the body controller 106. Thus, the paper sheet processing controller 23 detects a transportation amount of the paper sheet P by measuring predetermined time according to the size of the paper sheet P based on the passage timing of the front edge portion of the paper sheet P, and stops the transporting rolls 44 and the transporting rolls 45 when the transportation amount comes to a point where the center portion of the paper sheet P reaches the arrangement position of the fold blade 42.

When the transporting rolls 44 and the transporting rolls 45 are stopped, while the paper sheet P is held by the transporting rolls 44 and the transporting rolls 45, the cam 43 moves the holder 48 from the lower side toward the fold base portion 41. By this operation, the paper sheet fixing member 47 presses and fixes the paper sheet P onto the fold base portion 41 on the front and rear sides in the transporting direction of the paper sheet P of the fold blade 42. Approximately simultaneously, the fold blade 42 presses the central portion of the paper sheet P in the direction of the groove portion 41*a*. As a result, a fold as shown in FIG. 3C is formed at the central portion of the paper sheet P.

When the fold is formed on the paper sheet P, the cam 43 moves the holder 48 downward. To the holder 48 supporting the fold blade 42 and the paper sheet fixing member 47, a spring (not shown in the figure) that biases the holder 48 downward is mounted, and when the cam 43 is retracted downward, the holder 48 is moved downward by the biasing force of the spring.

After the holder 48 has been moved downward, the transporting rolls 44 and the transporting rolls 45 resume the transportation of the paper sheet P and transports the paper sheet P out of the folding function portion 40.

Then the paper sheet P which is transported out of the transporting rolls 45 of the folding function portion 40 is sequentially collected on the compiling tray 60 arranged on a position where the paper sheet P is transported out of the transporting rolls 45 and falls.

Here, in the finisher unit 22 of the present exemplary embodiment, while the fold is formed on the paper sheet P by the fold blade 42 and the paper sheet P is collected on the compiling tray 60, only the transporting rolls 45 are arranged as a member that is brought into contact with the paper sheet P on which the fold is formed, with pressure. Therefore, till the paper sheet P is collected on the compiling tray 60, flattening of the fold formed on the paper sheet P is restrained.

Figure 4:
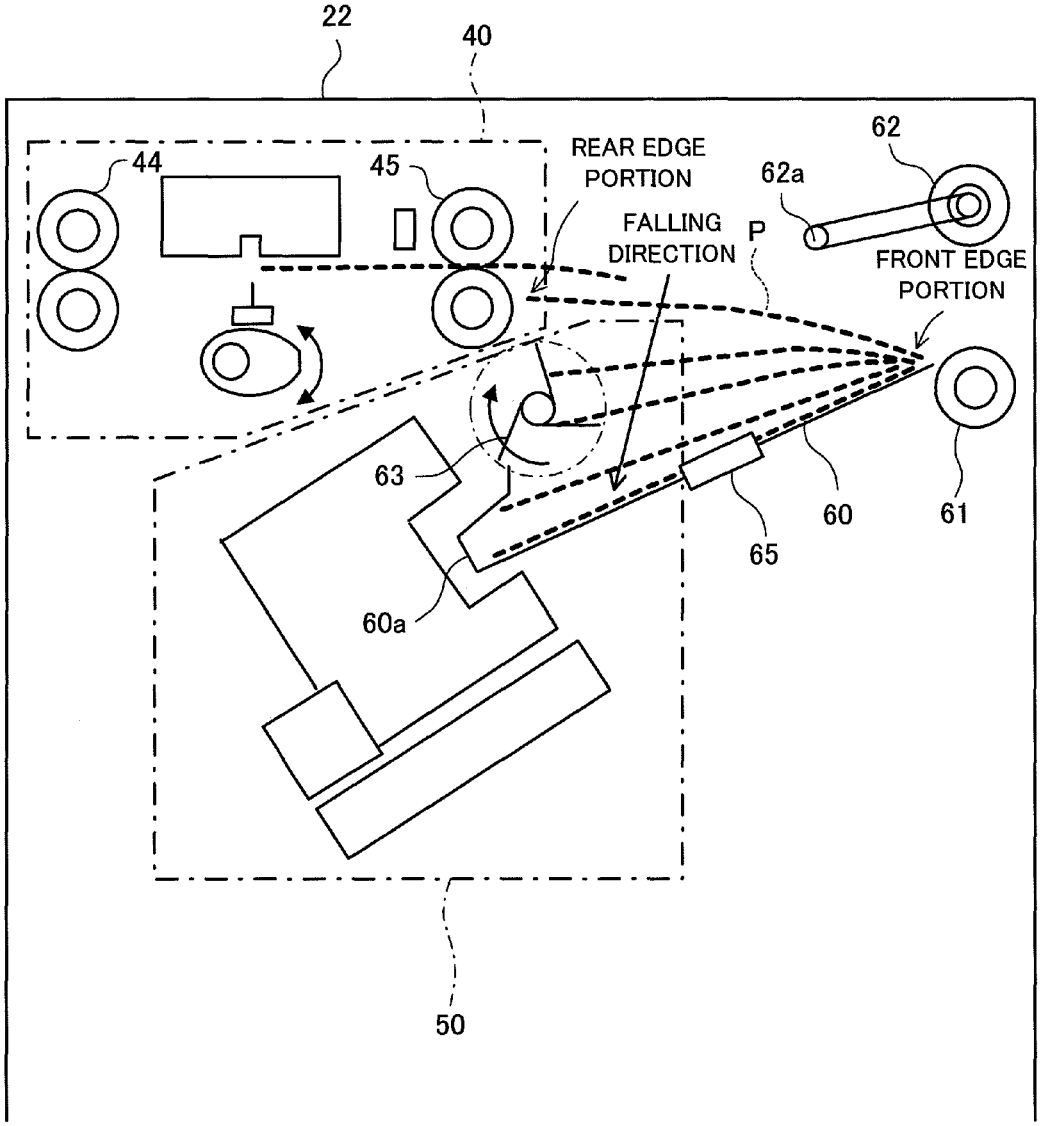
FIG. 4 is a diagram for explaining a state where the paper sheet transported out of the transporting rolls of the folding function portion is collected on the compiling tray.

FIG. 4 is a diagram for explaining a state where the paper sheet P transported out of the transporting rolls 45 of the folding function portion 40 is collected on the compiling tray 60. As shown in FIG. 4, when the fold is formed on the paper sheet P and the transportation of the paper sheet P by the transporting rolls 44 and the transporting rolls 45 is resumed, the front edge portion of the paper sheet P transported out of the folding function portion 40 heads downward in the vertical direction by gravity. During that time, since the paper sheet P has predetermined rigidity (what is called "stiffness"), respectively, the front edge portion of the paper sheet P is supported in a region on the front side in the transporting direction of the paper sheet P (the exit roll 61 side) on the compiling tray 60 arranged on the position where the paper sheet P falls. In that case, the compiling tray 60 of the present exemplary embodiment is arranged in a state where the front side in the transporting direction of the paper sheet P (the exit roll 61 side) is inclined upward approximately by 35 degrees with respect to the horizontal face. As a result, a falling distance in the vertical direction of the front edge portion of the paper sheet P is reduced, and when the paper sheet P is sequentially collected on the compiling tray 60, large inclination of the attitude of the paper sheet P with respect to the horizontal face is prevented.

Further, since the compiling tray 60 is arranged on a position where the paper sheet P is transported out of the folding function portion 40 and falls, the front edge portion of the paper sheet P is supported by the compiling tray 60 while being held by the transporting rolls 45. By this arrangement, variation in the collected positions of the paper sheet P on the compiling tray 60 is kept small.

After the front edge portion of the paper sheet P is supported by the compiling tray 60, a rear edge portion of the paper sheet P passes the transporting rolls 45. Then, subsequent to the front edge portion of the paper sheet P, the rear edge portion of the paper sheet P falls downward, but in this case, the rear end portion of the paper sheet P falls downward while the front edge portion of the paper sheet P is supported by the compiling tray 60. Therefore, the paper sheet P is collected on the compiling tray 60 while positional variation in the width direction is kept small. It should be noted that the "width direction" of the paper sheet P refers to a direction orthogonal to the transporting direction of the paper sheet P. The same is applied below.

After that, when the entire paper sheet P is loaded on the compiling tray 60, the paper sheet P slides and falls toward a positioning stopper 60*a* owing to an inclination angle provided for the compiling tray 60. In the finisher unit 22 of the present exemplary embodiment, in addition to the inclination angle provided for the compiling tray 60, a paddle 63 that rotates for aligning the paper sheets P toward the positioning stopper 60*a* of the compiling tray 60 is arranged below a paper sheet exit portion of the folding function portion 40. Therefore, the rear edge portion of the paper sheet P is transported toward the positioning stopper 60*a* by the paddle 63 while falling toward the compiling tray 60. By this arrangement, the rear edge portions of the paper sheets P are aligned by the positioning stopper 60*a* and a paper sheet bundle P is formed in the compiling tray 60.

In the both edge portions in the width direction of the compiling tray 60, a paper sheet width-position alignment mechanism 65 is provided for aligning the position of the paper sheet bundle P in the width direction according to the size of the transported paper sheets P. As a result, when the paper sheet P is sequentially collected on the compiling tray 60, the positions of the paper sheets P (paper sheet bundle P) in the width direction are also aligned.

When the paper sheet P is transported out of the transporting rolls 45 of the folding function portion 40, the movable roll 62 has been moved to a position retracted from the exit roll 61.

When the predetermined number of paper sheets P are collected on the compiling tray 60 and the paper sheet bundle P is formed, staple stitching (edge stitching) on the edge portion of the paper sheet bundle P by the edge stitching staple function portion 50 or staple stitching (saddle-stitching), by the saddle-stitching staple function portion 70, on the central portion of the paper sheet bundle P on which the fold has been made by the folding function portion 40 is executed.

Figure 5:
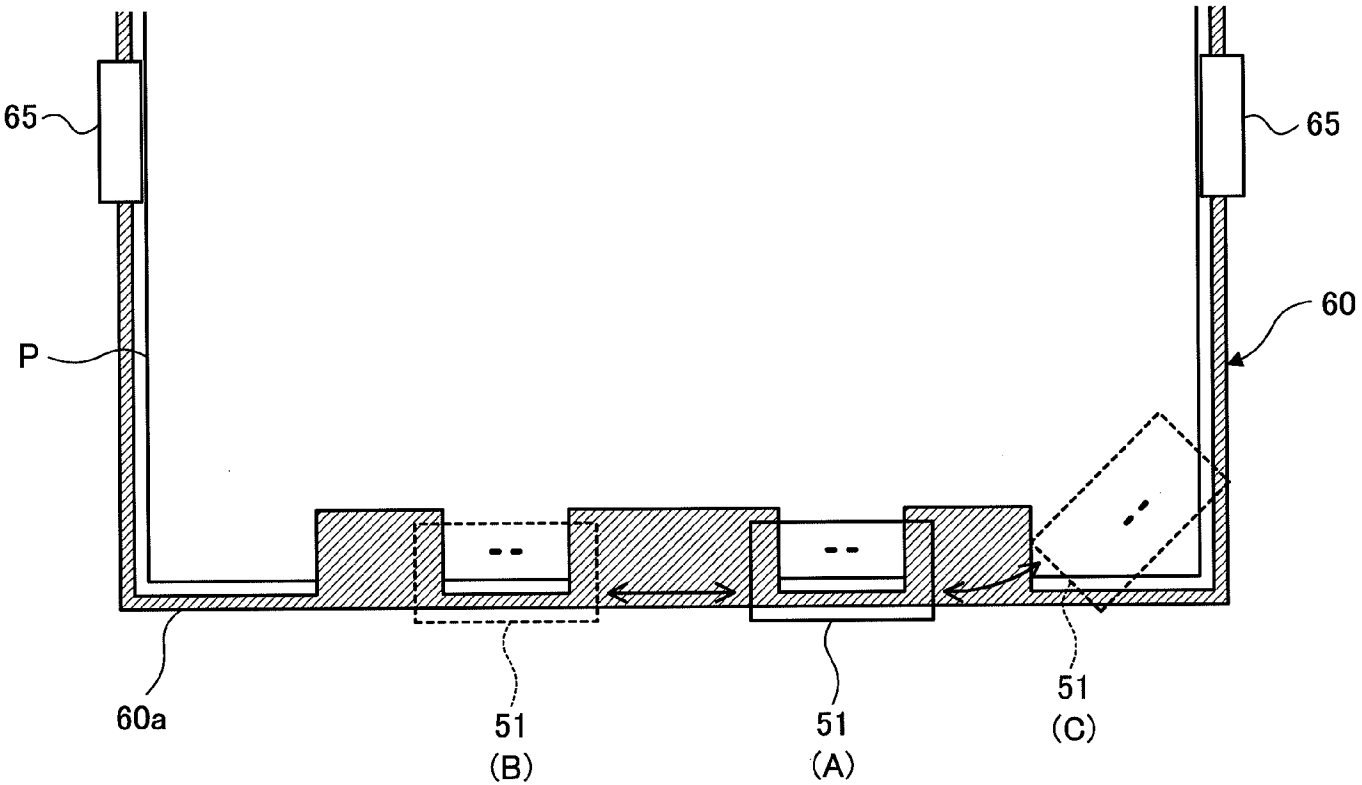
FIG. 5 is a diagram for explaining a state where the staple stitching (edge stitching) is executed on the edge portion of the paper sheet bundle by the edge stitching staple function portion.

First, when the paper sheet processing controller 23 has transmitted an instruction signal for the edge stitching processing, the edge stitching staple function portion 50 executes staple stitching (edge stitching) on the edge portion of the paper sheet bundle P. FIG. 5 is a diagram for explaining a state where the staple stitching (edge stitching) is executed on the edge portion of the paper sheet bundle P by the edge stitching staple function portion 50, and shows a state where the compiling tray 60 is seen from above (the folding function portion 40 side).

In the edge stitching staple function portion 50, a staple head 51 for stitching the paper sheet bundle P with a staple (a stitching needle) is provided movably along the positioning stopper 60*a* of the compiling tray 60. Further, as shown in FIG. 5, according to the instruction signal from the paper sheet processing controller 23, two points in parallel with the positioning stopper 60*a* in the edge portion of the paper sheet bundle P ((A) position and (B) position in FIG. 5) are staple-stitched (two-point edge stitching) or one end ((C) position in FIG. 5) is staple-stitched (one-point edge stitching), for example.

The staple head 51 is moved in parallel along the positioning stopper 60*a* between the (A) position and the (B) position, but the staple head 51 is moved with rotation by, for example, 45 degrees between the (A) position and the (C) position.

After the edge stitching for the paper sheet bundle P is executed by the edge stitching staple function portion 50, the movable roll 62 (refer to FIG. 4), which moves around the rotation axis 62*a* as a center of movement, moves to a position where the movable roll 62 is brought into contact with the exit roll 61, with pressure. Then, the exit roll 61 and the movable roll 62 start rotating, and they transport the edge-stitched paper sheet bundle P from the compiling tray 60 to the stacker tray 80. The exit roll 61 and the movable roll 62 of this case function as a transportation unit that transports the paper sheet bundle P to the stacker tray 80.

Figure 6:
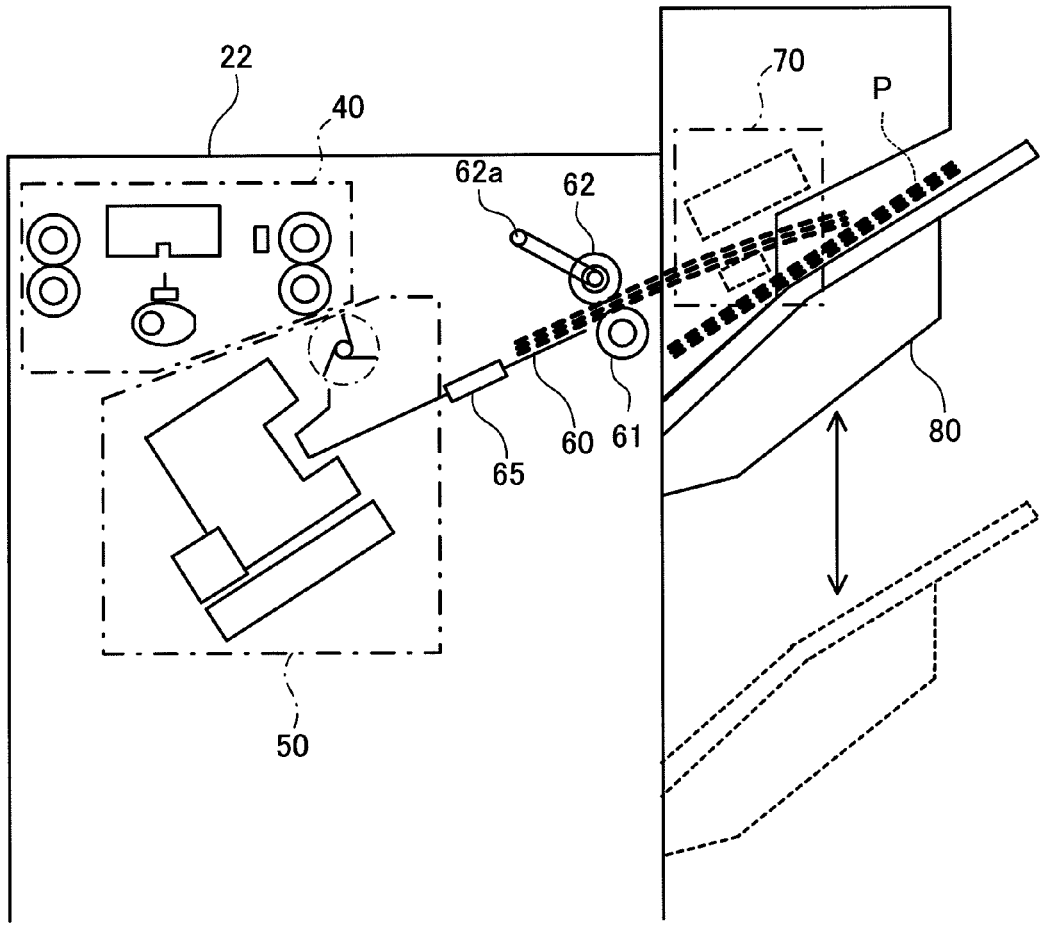
FIG. 6 is a diagram for explaining the state where the edge-stitched paper sheet bundle is transported out of the compiling tray.

FIG. 6 is a diagram for explaining the state where the edge-stitched paper sheet bundle P is transported out of the compiling tray 60. As shown in FIG. 6, the edge-stitched paper sheet bundle P is transported by the exit roll 61 and the movable roll 62, and stacked on the stacker tray 80.

It should be noted that, in this case, the saddle-stitching staple function portion 70 has moved to a position where the saddle-stitching staple function portion 70 is retracted from the transporting route of the paper sheet bundle P that is to be transported (a home position described below).

Next, a description is given for the staple stitching (saddle-stitching) on the central portion of the paper sheet bundle P in the saddle-stitching staple function portion 70, which is executed in the case where the paper sheet processing controller 23 transmits an indication signal of the saddle stitching processing.

Figure 7:
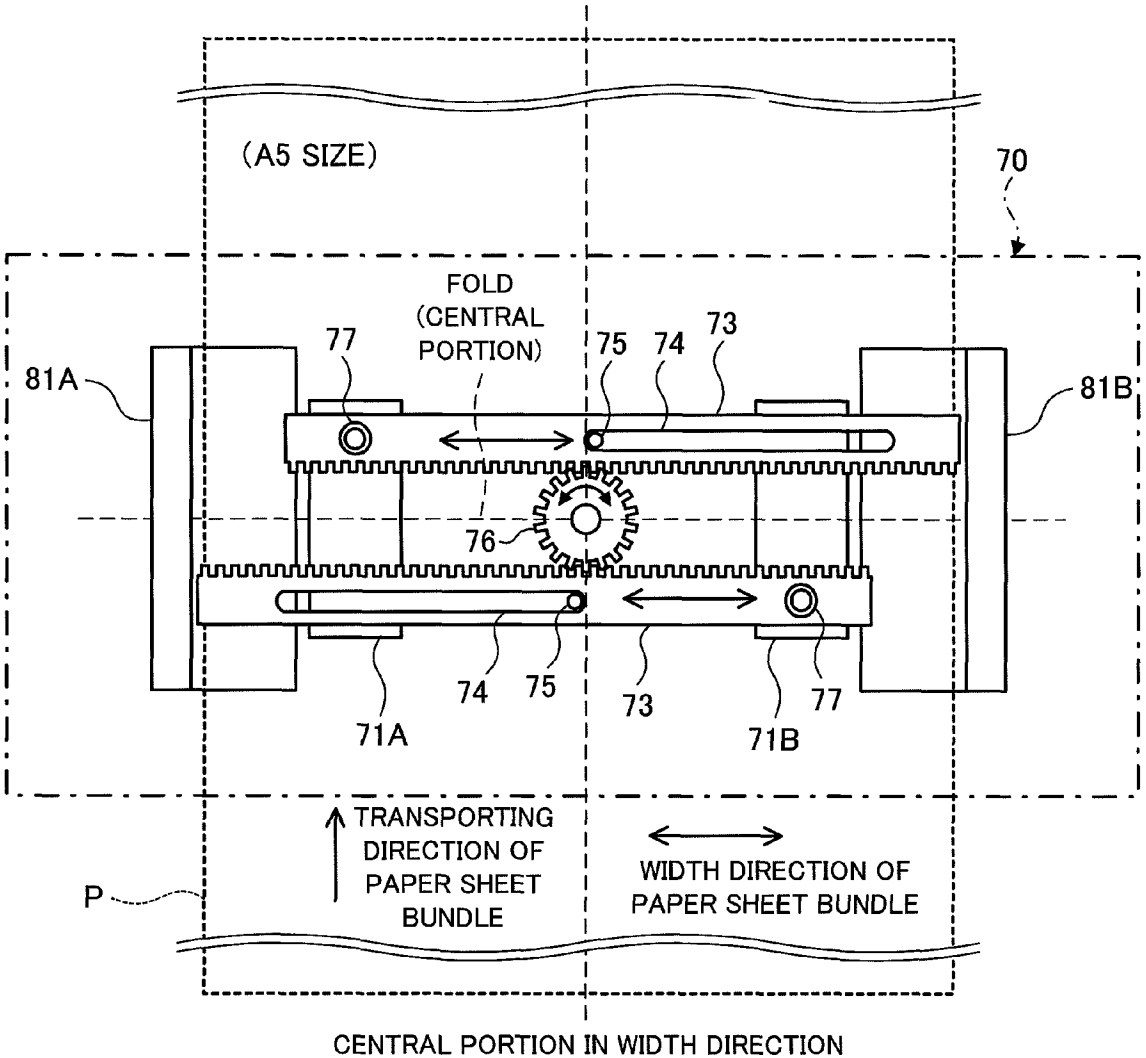
FIG. 7 is a plain view for explaining the moving mechanism that slidably moves the staple heads.
Figure 8:
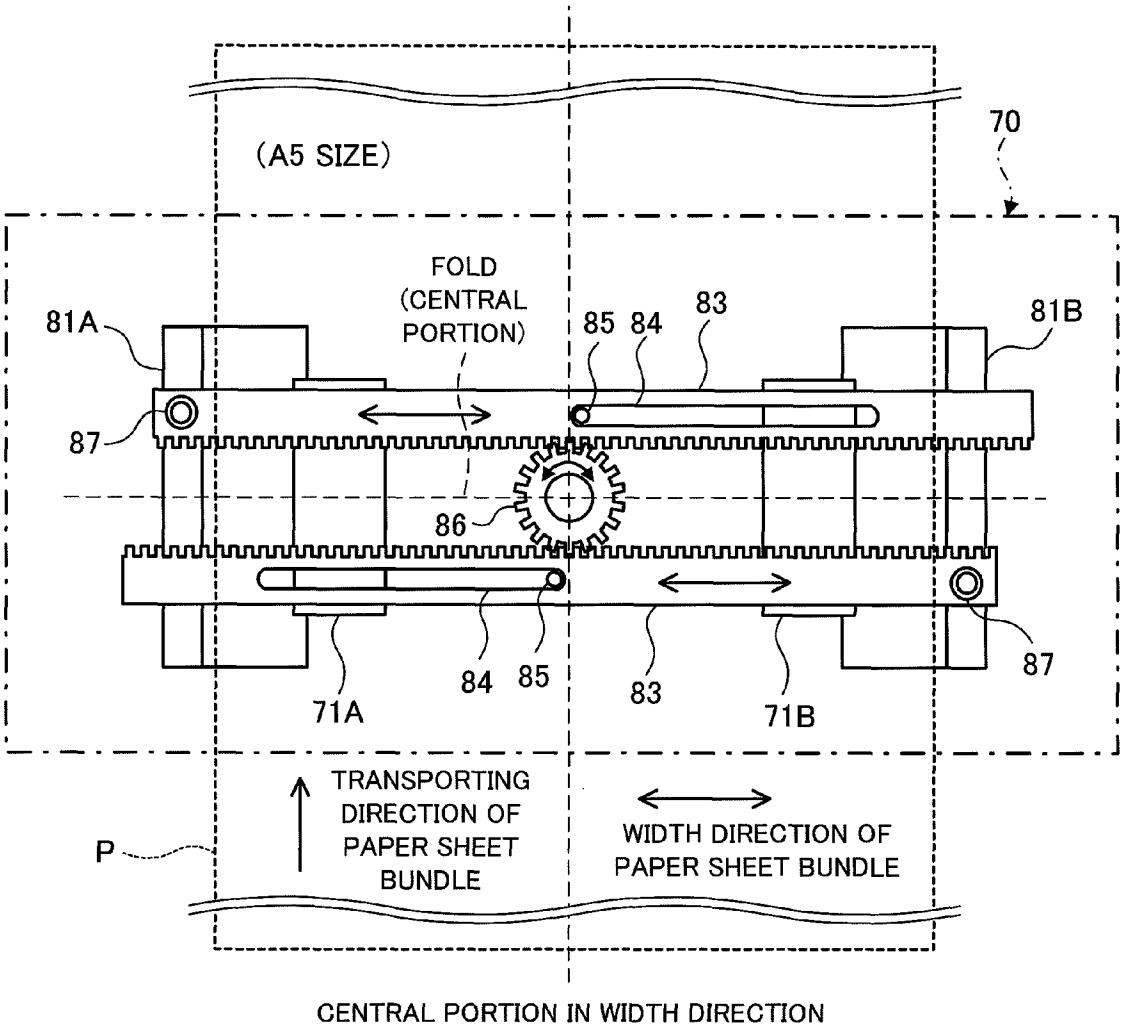
FIG. 8 is a plain view for explaining the moving mechanism that slidably moves the booklet trays.
Figure 9:
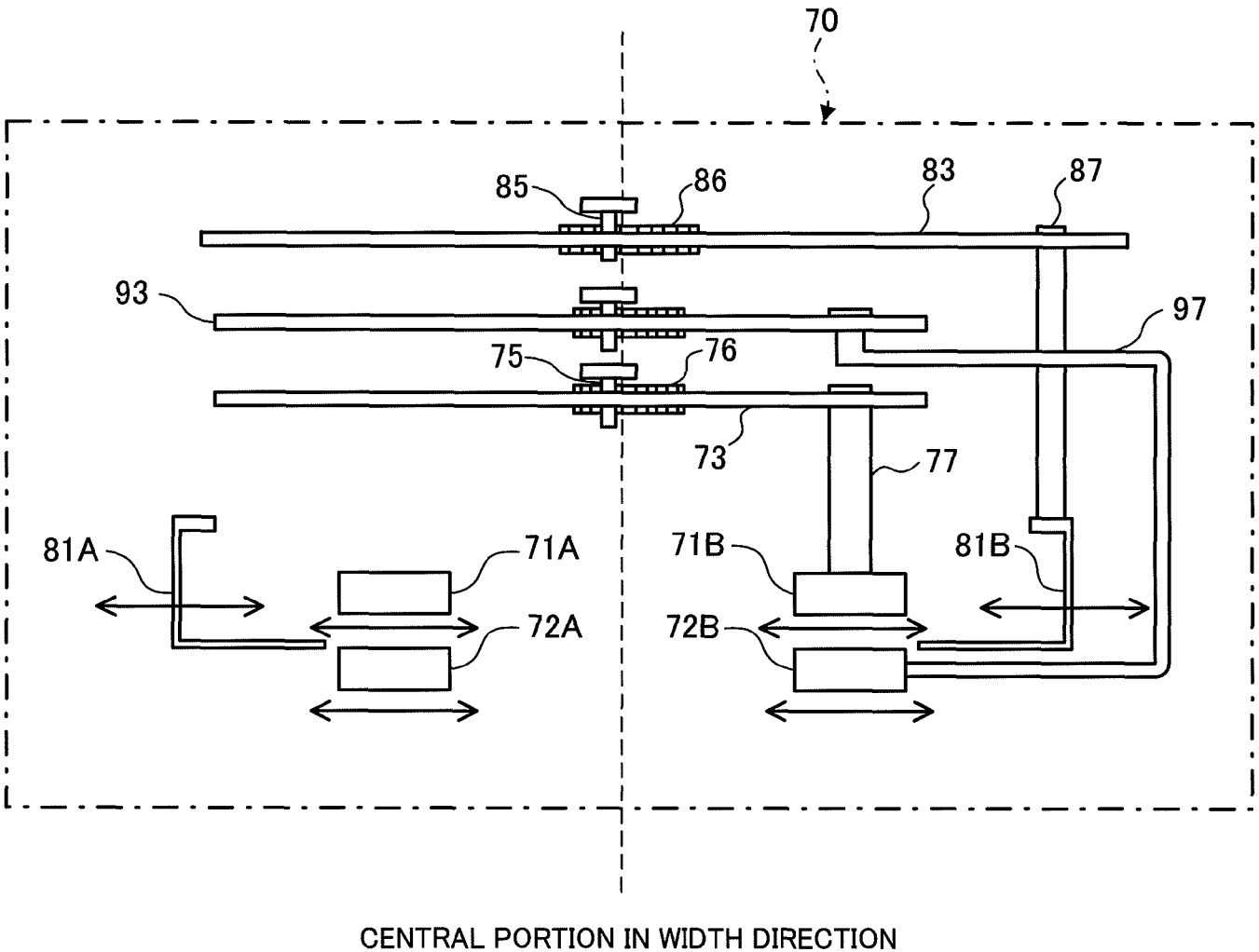
FIG. 9 is a schematic sectional-view for explaining a part of the supporting mechanism that supports the respective parts of the saddle-stitching staple function portion.

First, a description is given for the configuration of the saddle-stitching staple function portion 70. FIGS. 7 to 9 are diagrams for explaining the configuration of the saddle-stitching staple function portion 70. FIG. 7 is a plain view for explaining the moving mechanism that slidably moves the staple heads 71A and 71B. FIG. 8 is a plain view for explaining the moving mechanism that slidably moves the booklet trays 81A and 81B. FIG. 9 is a schematic sectional-view for explaining a part of the supporting mechanism that supports the respective parts of the saddle-stitching staple function portion 70, which is seen from the compiling tray 60 side.

As shown in FIGS. 7 to 9, the saddle-stitching staple function portion 70 is configured to have an opening at the lower side where the stacker tray 80 is arranged (refer to FIG. 6), and is provided with two staple heads 71A and 71B as an example of a stapler portion that stitches a paper sheet bundle P by a staple, base parts 72A and 72B (shown in FIG. 9) as an example of a base portion that is a base for stapling a paper sheet bundle P by the staple heads 71A and 71B, and the booklet trays 81A and 81B as an example of a supporting portion that supports both end portions of the paper sheet bundle P in the width direction.

In the saddle-stitching staple function portion 70 of the present exemplary embodiment, the staple heads 71A and 71B, the base parts 72A and 72B and the booklet trays 81A and 81B are configured so as to move along the width direction of the paper sheet bundle P in accordance with the size of the paper sheet bundle P. For example, FIGS. 7 and 8 show a setting in the case where the staple stitching (the saddle-stitching) is executed for the paper sheet bundle P of, for example, A5 size that is the smallest size handled in the image forming apparatus 1. The staple heads 71A and 71B, the base parts 72A and 72B, and the booklet trays 81A and 81B move toward the end portions of the paper sheet bundle P in the width direction (the outer sides) from the positions shown in FIGS. 7 and 8 in accordance with the size of the paper sheet P. In the case of completion of the staple stitching (the saddle-stitching) for the paper sheet bundle P or the like, they move outside the end portions of the paper sheet bundle P in the width direction, and causes the saddle-stitched paper sheet bundle P to be discharged from the opening on the lower side to the stacker tray 80.

A specific configuration of the saddle-stitching staple function portion 70 is described. As shown in FIGS. 7 and 9, the respective staple heads 71A and 71B are supported so as to be suspended from two supporting frames 73 arranged on upper positions of the staple heads 71A and 71B. To be more specific, the supporting frames 73 are provided with supporting columns 77 that extend downward, and the staple heads 71A and 71B are fixed to the supporting frames 73 through the supporting columns 77 respectively. It should be noted that, in FIG. 9, only a supporting mechanism that supports the staple head 71B, the base part 72B and the booklet tray 81B is shown. However, with regard to the staple head 71A, the base part 72A and the booklet tray 81A, the same configuration is employed. The supporting frames 73 here are a holding portion, and configure a moving unit.

In addition, each of the supporting frames 73 has a rack gear (a spur gear having the infinite diameter) that configures a moving unit. Each of the rack gears of the supporting frames 73 is engaged with a shared pinion gear 76. Therefore, by rotating the pinion gear 76 configuring a moving unit, each of the supporting frames 73 moves along the width direction of the paper sheet bundle P (an arrow direction of FIG. 7). To be more specific, by rotating the pinion gear 76 in a direction opposite to the clockwise direction in FIG. 7, both of the two supporting frames 73 move toward the end portions of the paper sheet bundle P in the width direction, respectively. Alternatively, by rotating the pinion gear 76 in the clockwise direction, both of the two supporting frames 73 move toward the central portion of the paper sheet bundle P in the width direction. In accordance with this movement, the staple heads 71A and 71B move, along the width direction of the paper sheet bundle P, in the directions of the end portions respectively or the direction of the central portion, at the same time.

The two supporting frames 73 form guide rails 74, respectively. Inside the guide rail 74, a guide pin 75 fixed on a body frame (not illustrated in the figure) of the saddle-stitching staple function portion 70 is arranged so as to penetrate. Thereby, since the guide pin 75 arranged inside the guide rail 74 restricts the moving direction when the two supporting frames 73 move, the displacement of the staple heads 71A and 71B in the direction orthogonal to the width direction of the paper sheet bundle P is suppressed.

In addition, since the staple heads 71A and 71B are supported so as to be suspended by the two supporting frames 73 arranged on the upper position of the staple heads 71A and 71B, they do not interfere with the transporting route of the paper sheet P. Thereby, the transportation of the paper sheet bundle P to the booklet trays 81A and 81B is not obstructed.

As shown in FIG. 9, the base parts 72A and 72B are supported so as to be suspended by the two supporting frames 93 respectively and move, by the supporting mechanism and the moving mechanism that are similar to those of the staple heads 71A and 71B. The base parts 72A and 72B are arranged on positions opposed to the staple heads 71A and 71B respectively, while the paper sheet bundle P is sandwiched in between. Therefore, each of the supporting columns 97 for suspending the base parts 72A and 72B is formed to be a rectangular shape having a opening portion at one side so that the supporting column 97 does not interfere with the transporting route of the paper sheet bundle P and bypasses the transporting route of the paper sheet bundle P to the booklet trays 81A and 81B.

Next, as shown in FIGS. 8 and 9, the booklet trays 81A and 81B are also supported so as to be suspended by the two supporting frames 83 respectively, by a supporting mechanism and a moving mechanism similar to those of the staple heads 71A and 71B. To be more specific, the booklet trays 81A and 81B are supported so as to be suspended through the supporting columns 87 by the two supporting frames 83 arranged on upper positions of the booklet trays 81A and 81B, respectively. The supporting frame 83 here is a holding portion, and configures a moving unit.

In each of the supporting frames 83, each of the rack gears that configures a moving unit is engaged with the pinion gear 86. Accordingly, by rotating the pinion gear 86 that configures a moving unit, each of the supporting frames 83 moves along the width direction of the paper sheet bundle P (an arrow direction of FIG. 8). To be more specific, by rotating the pinion gear 86 in a direction opposite to the clockwise direction in FIG. 8, both of the two supporting frames 83 move toward the end portions of the paper sheet P in the width direction, respectively. In contrast, by rotating the pinion gear 86 in the clockwise direction, both of the two supporting frames 83 move toward the central portion of the paper sheet P in the width direction. In accordance with the movement, the booklet trays 81A and 81B move along the width direction of the paper sheet bundle P in the directions to the end portions respectively or the direction to the central portion, at the same time.

In the two supporting frames 83, guide rails 84 are formed, respectively. Inside the guide rail 84, the guide pin 85 fixed to the body frame (not illustrated in the figure) of the saddle-stitching staple function portion 70 is arranged so as to penetrate. Thereby, since the moving direction is restricted by the guide pins 85 arranged inside the guide rails 84 when the two supporting frames 83 move, the displacement of the booklet trays 81A and 81B to a direction orthogonal to the width direction of the paper sheet bundle P is suppressed.

As described above, in the saddle-stitching staple function portion 70 of the present exemplary embodiment, the staple heads 71A and 71B, the base parts 72A and 72B, and the booklet trays 81A and 81B move along the width direction of the paper sheet bundle P in accordance with the size of the paper sheet P. The paper sheet processing controller 23 sets the positions of the staple heads 71A and 71B, the base parts 72A and 72B, and the booklet trays 81A and 81B according to the information on the size of the paper sheet P transported to the sheet post-processing apparatus 2, which is acquired from the body controller 106, and move them to the set positions.

Figure 10:
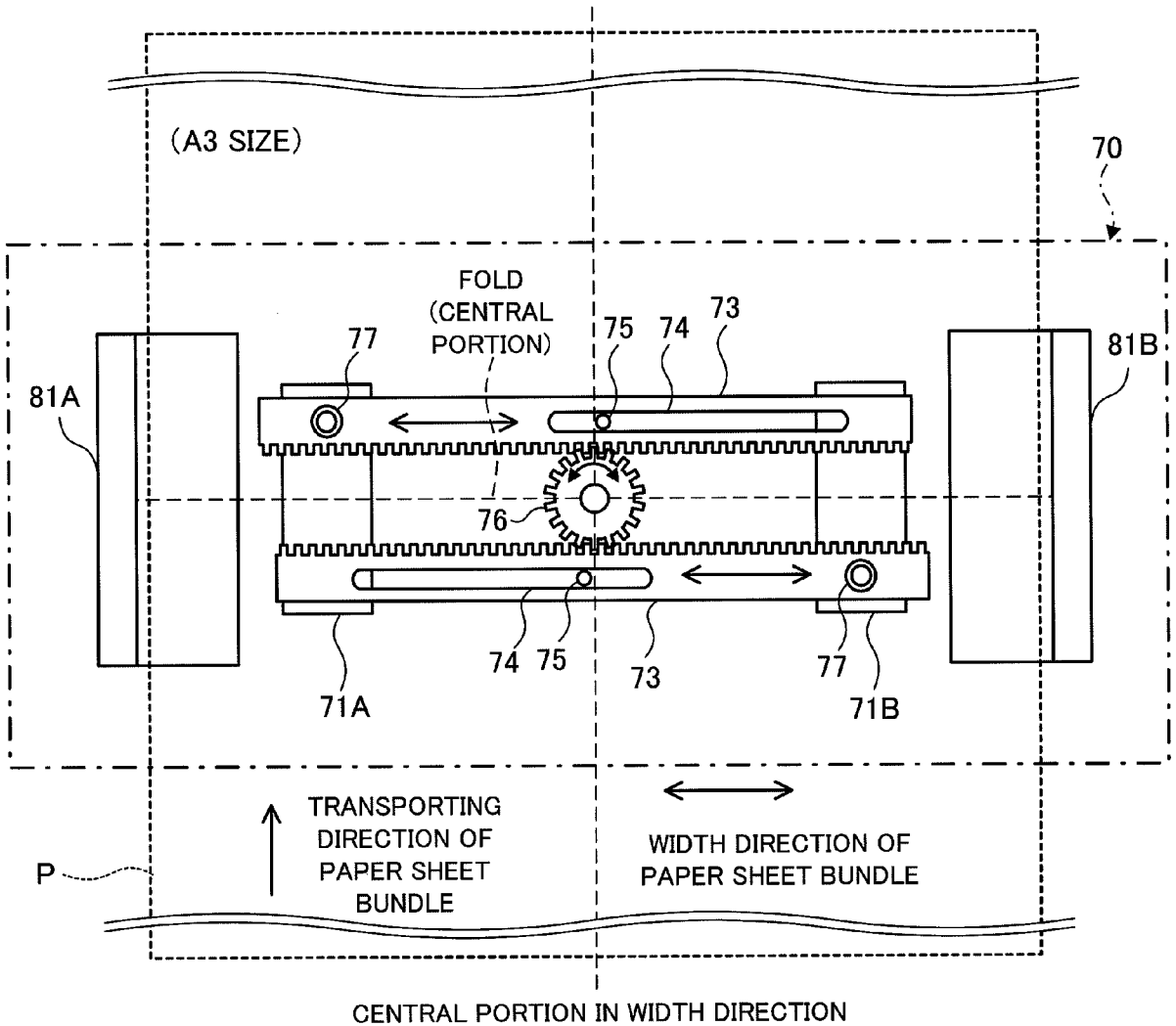
FIGS. 10 and 11 are diagrams for explaining positions of the staple heads and booklet trays set by the moving mechanism that makes them move respectively, in the case where the paper sheet transported to the sheet post-processing apparatus is, for example, a paper sheet bundle of A3 size that is the maximum size handled in the image forming apparatus.
Figure 11:
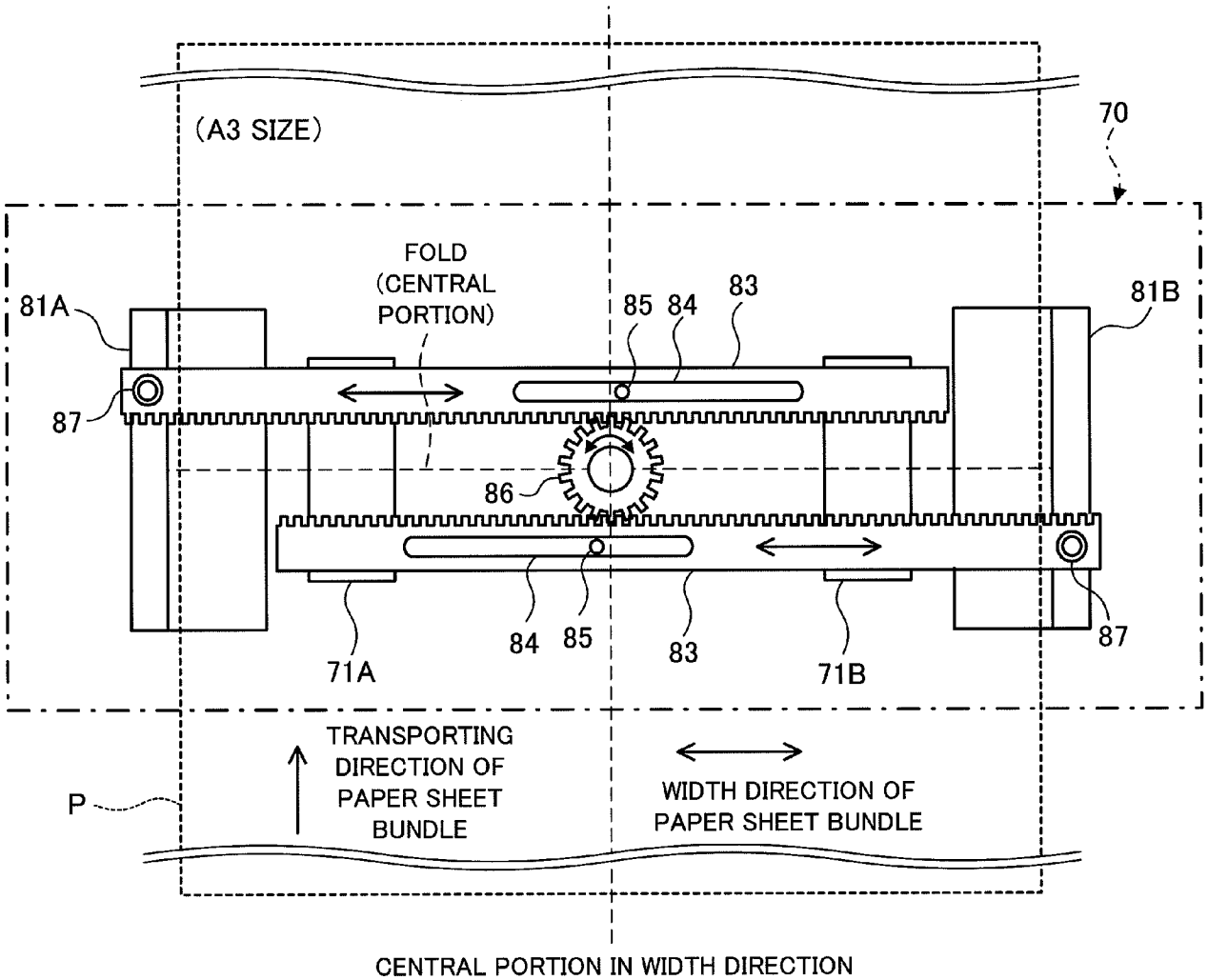

Next, FIGS. 10 and 11 are diagrams for explaining positions of the staple heads 71A and 71B, and booklet trays 81A and 81B set by the moving mechanism that makes them move respectively, in the case where the paper sheet P transported to the sheet post-processing apparatus 2 is, for example, a paper sheet bundle P of A3 size that is the maximum size handled in the image forming apparatus 1.

As shown in FIG. 11, the booklet trays 81A and 81B are moved to the positions of the edge portions of the paper sheet bundle P of A3 size by the moving mechanism and support regions of the edge portions of the paper sheet bundle P. As shown in FIG. 10, the staple heads 71A and 71B are moved to predetermined positions at the central portion of the paper sheet bundle P of A3 size by the moving mechanism.

When the immediately preceding paper sheet bundle P transported to the sheet post-processing apparatus 2 is, for example, the paper sheet bundle P of A5 size which is the smallest size (refer to FIGS. 7 and 8), in order to move the staple heads 71A and 71B and the booklet trays 81A and 81B to the positions for the saddle-stitching processing for the paper sheet bundle P of A3 size, which is the largest size, shown in FIGS. 10 and 11, the pinion gear 76 and the pinion gear 86 are rotated in the direction opposite to the clockwise direction in FIGS. 10 and 11. As a result of this, they are moved in the directions of the edge portions along the width direction of the paper sheet bundle P.

The base parts 72A and 72B are arranged on positions opposed to the staple heads 71A and 71B by the similar moving mechanism while the paper sheet bundle P is sandwiched in between.

Next, a description is given for an operation in the finisher unit 22 in the case where the saddle-stitching processing is performed in the saddle-stitching staple function portion 70. If the paper sheet processing controller 23 transmits an instruction signal for the saddle-stitching processing, the paper sheet bundle P is transported to the saddle-stitching staple function portion 70 as follows. When the paper sheet processing controller 23 transmits the instruction signal for the saddle-stitching processing, the exit roll 61 and the movable roll 62 transport the paper sheet bundle P by a predetermined amount on the basis of information on the size of the paper sheet P acquired from the body controller 106. By this operation, the central portion of the paper sheet bundle P on which the fold is formed and the arrangement positions of the staple heads 71A and 71B are matched with each other. The exit roll 61 and the movable roll 62 in this case function as a positioning unit for aligning the central portion of the paper sheet bundle P to the positions of the staple heads 71A and 71B.

On the other hand, in the saddle-stitching staple function portion 70, according to the instruction signal by the paper sheet processing controller 23 which has acquired the information on the size of the paper sheet P from the body controller 106, the booklet trays 81A and 81B are arranged on the positions for supporting the paper sheet bundle P (the position of the edge portion of the paper sheet bundle P). Further, the staple heads 71A and 71B and the base parts 72A and 72B are arranged on the predetermined positions in the width direction of the paper sheet bundle P corresponding to the size of the paper sheet P.

As a result, the staple heads 71A and 71B execute stitching (saddle-stitching) processing on predetermined two positions at the central portion where the fold is formed, for the paper sheet bundle P supported by the booklet trays 81A and 81B.

After the paper sheet bundle P has been saddle-stitched, the staple heads 71A and 71B, the base parts 72A and 72B, and the booklet trays 81A and 81B are moved to the home positions. To be more specific, the staple heads 71A and 71B, the base parts 72A and 72B, and the booklet trays 81A and 81B are moved to predetermined positions (home positions) outside the edge portions of the paper sheet bundle P of, for example, A3 size which is the maximum size handled in the image forming apparatus 1.

Figure 12:
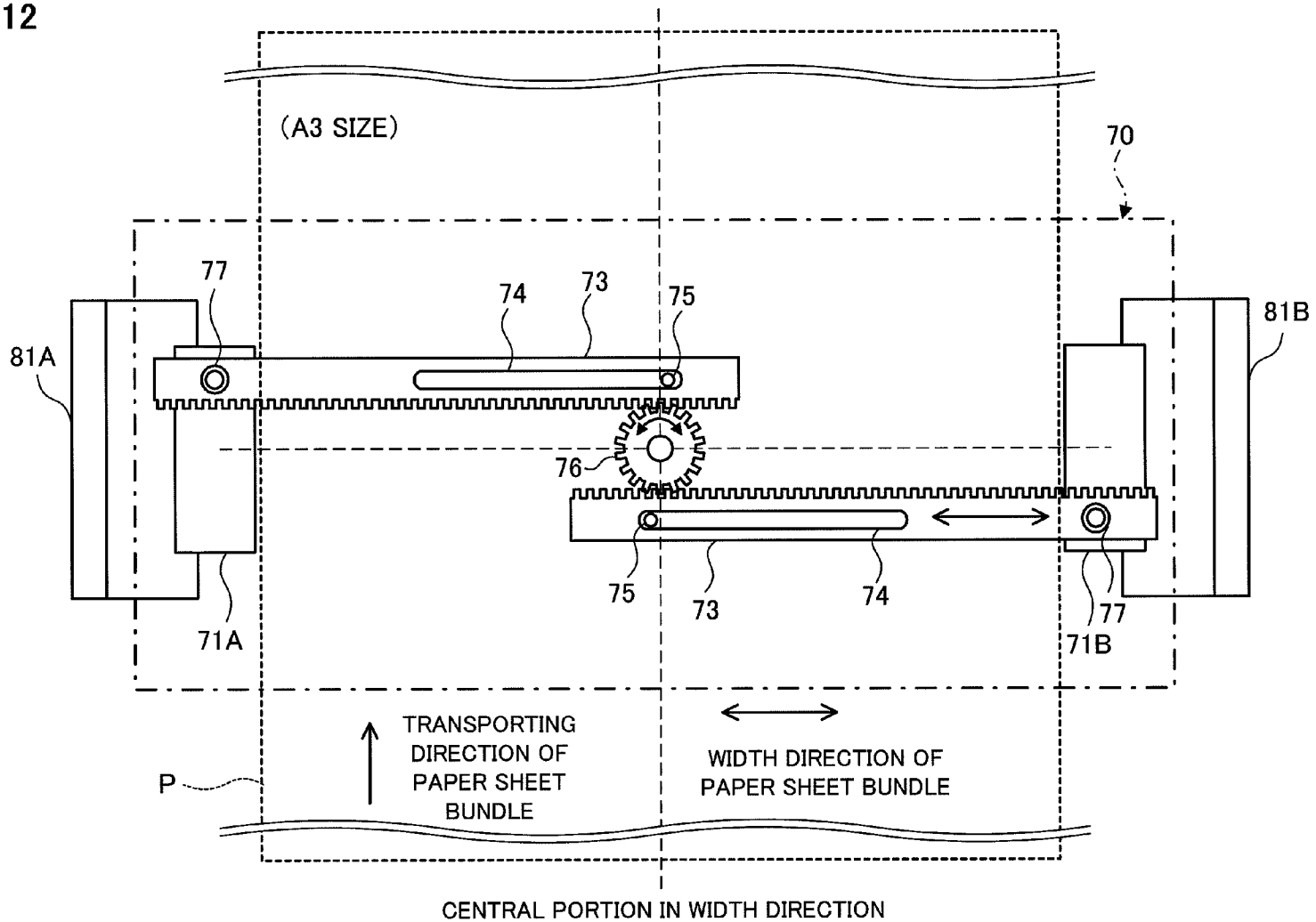
FIGS. 12 and 13 are diagrams for explaining positions of the staple heads and the booklet trays when the moving mechanism moves them to the home positions respectively.
Figure 13:
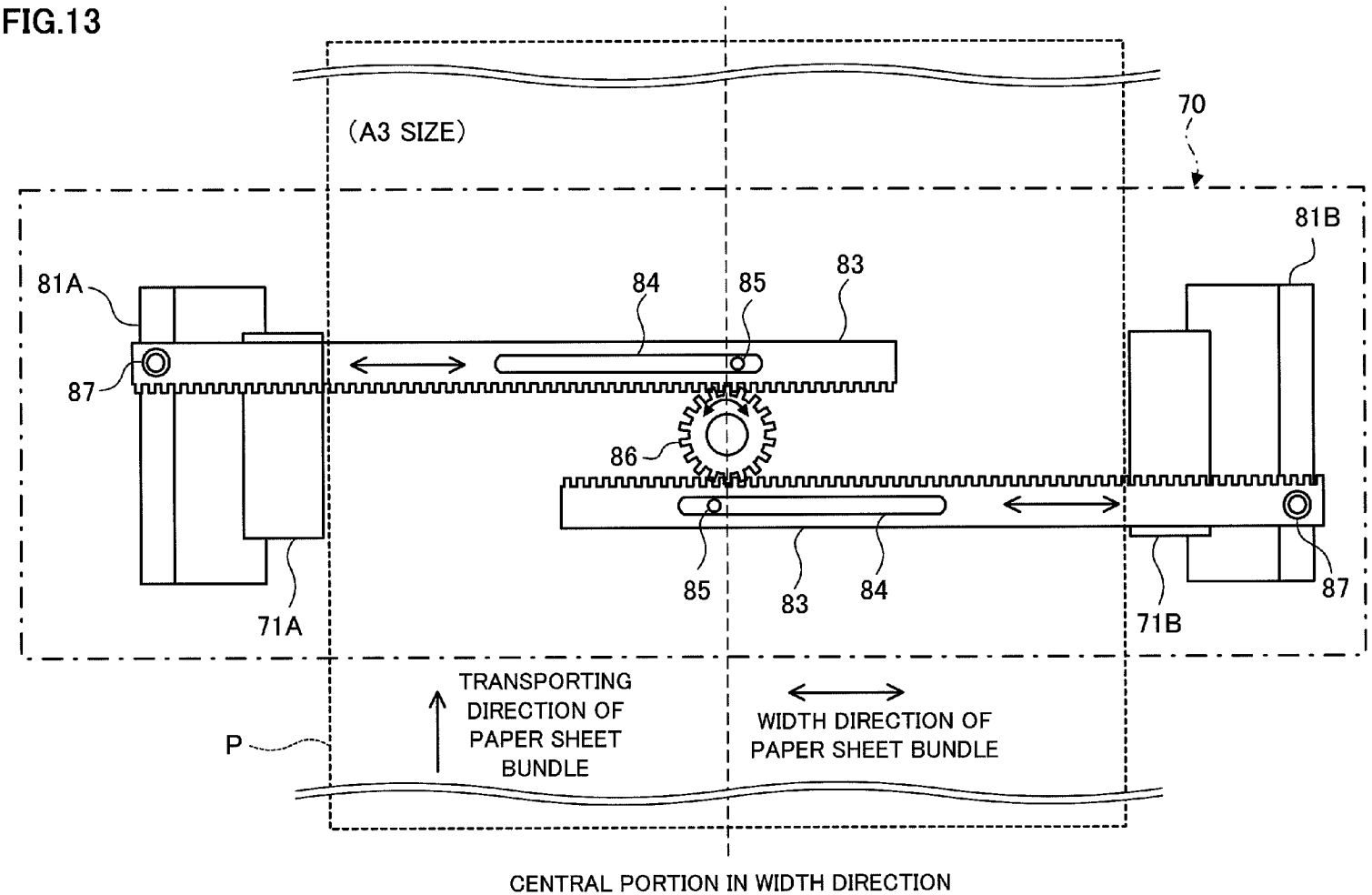

FIGS. 12 and 13 are diagrams for explaining positions of the staple heads 71A and 71B and the booklet trays 81A and 81B when the moving mechanism moves them to the home positions respectively.

As shown in FIGS. 12 and 13, the staple heads 71A and 71B and the booklet trays 81A and 81B are moved to the predetermined positions (home positions) outside the positions at the edge portions of the paper sheet bundle P of A3 size by the moving mechanism, respectively. The same is applied to the base parts 72A and 72B which are not shown in the figures. By this arrangement, the paper sheet bundle P is released from the supported state by the booklet trays 81A and 81B. After that, the paper sheet bundle P is discharged from an opening on the lower side by the exit roll 61 and the movable roll 62, and stacked on the stacker tray 80 arranged below the saddle-stitching staple function portion 70. In this case, the exit roll 61 and the movable roll 62 function as a transportation unit that transports the paper sheet bundle P onto the stacker tray 80.

When the paper sheet processing controller 23 instructs the edge stitching processing and the paper sheet bundle P for which the edge stitching is executed by the edge stitching staple function portion 50 is transported likewise, the staple heads 71A and 71B, the base parts 72A and 72B, and the booklet trays 81A and 81B are moved to the home positions. As a result, the edge-stitched paper sheet bundle P merely passes the saddle-stitching staple function portion 70, is discharged from the opening on the lower side by the exit roll 61 and the movable roll 62, and is stacked on the stacker tray 80 arranged below the saddle-stitching staple function portion 70. The same is applied in a case where the paper sheet P without the stitching processing is transported. In this case, the exit roll 61 and the movable roll 62 also function as a transportation unit that transports the paper sheet bundle P onto the stacker tray 80.

As mentioned above, in the finisher unit 22 of the present exemplary embodiment, after the paper sheet bundle P is saddle-stitched, when the paper sheet bundle P for which the edge stitching is executed is transported or even when the paper sheet P without the stitching processing is transported, in the saddle-stitching staple function portion 70, the staple heads 71A and 71B, the base parts 72A and 72B, and the booklet trays 81A and 81B are moved to the home positions. As a result, the edge-stitched paper sheet bundle P, the saddle-stitched paper sheet bundle P and the paper sheet P without the stitching processing are transported on the same transporting route, respectively. Therefore, since there is no need to constitute separate transporting routes respectively, the size of the sheet post-processing apparatus 2 and the size of the image forming system including the image forming apparatus 1 may be reduced.

In that case, the staple heads 71A and 71B, the base parts 72A and 72B, and the booklet trays 81A and 81B are arranged on positions symmetrical to the central position in the width direction of the paper sheet bundle P (refer to FIGS. 7 to 13), respectively. By this arrangement, a moving length (stroke) of each of the staple heads 71A and 71B, the base parts 72A and 72B, and the booklet trays 81A and 81B is made to be short and the moving mechanism is configured to be small. Moreover, the time for moving may be reduced.

In the saddle-stitching staple function portion 70 of the present exemplary embodiment, a description is given for a case where the staple head 71A, the base part 72A and the booklet tray 81A, and the staple head 71B, the base part 72B and the booklet tray 81B are moved in directions different from each other in the width direction of the paper sheet bundle P, but the staple head 71A, the base part 72A and the booklet tray 81A, and the staple head 71B, the base part 72B and the booklet tray 81B may be configured to be moved in the same direction, respectively.

Alternatively, the staple heads 71A and 71B that are arranged on an upper position of the paper sheet bundle P may be arranged to be fixed, the base parts 72A and 72B and the booklet trays 81A and 81B that are arranged on a lower position of the paper sheet bundle P may be configured to be moved. This is because the staple heads 71A and 71B arranged on the upper position of the paper sheet bundle P do not obstruct the transportation of the paper sheet bundle P to the booklet trays 81A and 81B, and the configuration of the saddle-stitching staple function portion 70 is simplified.

Further, the base parts 72A and 72B may be configured integrally. Moreover, the base parts 72A and 72B may be configured to be supported by the compiling tray 60.

Furthermore, a guide member that guides the paper sheet bundle P to the arrangement positions of the staple heads 71A and 71B from the compiling tray 60 may be provided. The guide member is provided in order to reduce displacement caused at the position on the paper sheet bundle P which is saddle-stitched by the staple heads 71A and 71B.

The saddle-stitching staple function portion 70 may be configured so as to be detachable with respect to the sheet post-processing apparatus 2.

In addition, in the sheet post-processing apparatus 2 of the present exemplary embodiment, the saddle-stitching staple function portion 70 may be arranged on the position of the edge stitching staple function portion 50 and the edge stitching staple function portion 50 may be arranged on the position of the saddle-stitching staple function portion 70. In this case, the edge stitching staple function portion 50 is configured similarly to the saddle-stitching staple function portion 70 of the present exemplary embodiment.

The saddle-stitched paper sheet bundle P, the edge-stitched paper sheet bundle P and the paper sheet P without the stitching processing are all stacked on the stacker tray 80. The stacker tray 80 is configured so as to move downward according to the stacked amount of the paper sheet bundle P. By such movement, the stacked amount on the stacker tray 80 may be increased.

Moreover, by configuring the stacker tray 80 so that the saddle-stitched paper sheet bundle P, the edge-stitched paper sheet bundle P and the like are stacked in a mixed manner, a final collection spot for the paper sheet bundles P and the like after various post-processing is shared in the sheet post-processing apparatus 2. By this arrangement, a user may take out the post-processed paper sheet bundle P from one spot (the stacker tray 80) regardless of the type of the post-processing.

Figure 14A:
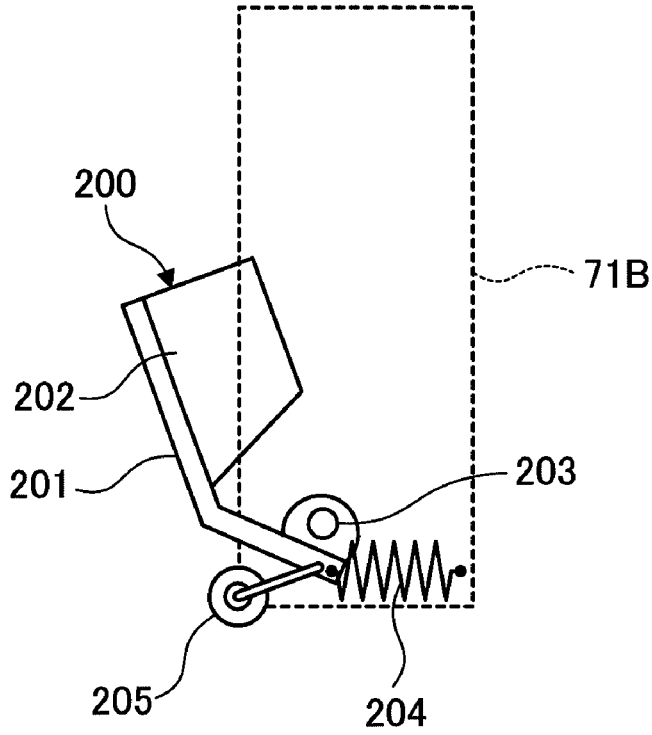
FIG. 14A shows the paper sheet supporting member in the state where the staple heads are set at the positions for performing the saddle-stitching processing.
Figure 14B:
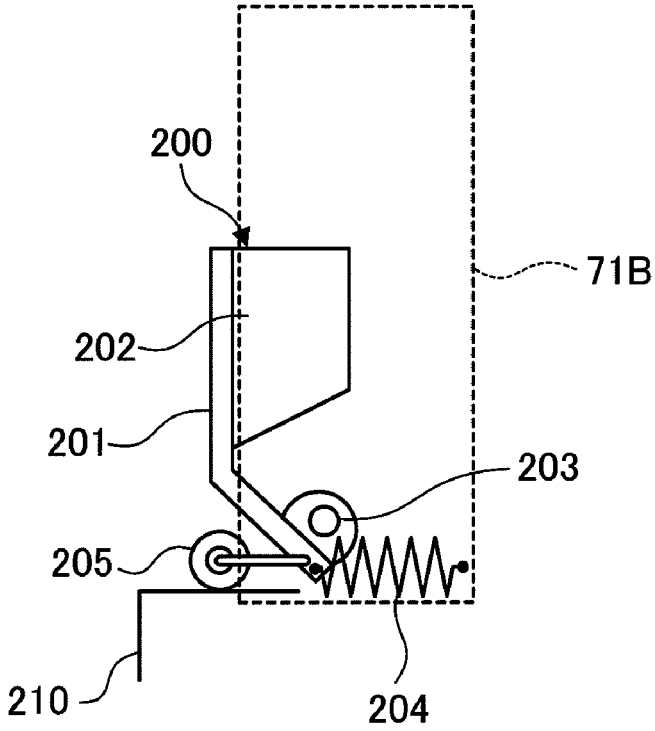
FIG. 14B shows the paper sheet supporting member in the state where the staple heads move to the home positions.

The staple heads 71A and 71B of the saddle-stitching staple function portion 70 may be configured with a paper sheet supporting member as an example of a recording-medium bundle supporting member that supports the paper sheet bundle P located near the staple heads 71A and 71B. FIGS. 14A and 14B are diagrams illustrating the configuration in which a paper sheet supporting member 200 is provided on the base parts 72A and 72B opposed to the staple heads 71A and 71B. The paper sheet supporting member 200 supports the paper sheet bundle P located near the staple heads 71A and 71B from a bottom face (a lowermost face) when the staple heads 71A and 71B execute the saddle-stitching processing, in other words, when the staple heads 71A and 71B are set at the positions other than the home positions.

Since the saddle-stitching staple function portion 70 of the present exemplary embodiment has a lower side configured by an opening, if a target to be saddle-stitched is a large-sized paper sheet of, for example, B4 size, A3 size or the like, loosening may easily be caused in a region at the central portion of the paper sheet bundle P supported only at both ends by the booklet trays 81A and 81B. As a result, the region of the paper sheet bundle P that is to be saddle-stitched by the staple heads 71A and 71B may be loosened, and displacement may be caused at the saddle-stitching position. Considering this, by providing the paper sheet supporting member 200 at the base parts 72A and 72B opposed to the staple heads 71A and 71B so as to support the paper sheet bundle P located near the staple heads 71A and 71B, the displacement which may be caused at the saddle-stitching position is reduced.

FIG. 14A shows the paper sheet supporting member 200 in the state where the staple heads 71A and 71B are set at the positions for performing the saddle-stitching processing, and FIG. 14B shows the paper sheet supporting member 200 in the state where the staple heads 71A and 71B move to the home positions. The paper sheet supporting member 200 shown in FIGS. 14A and 14B is arranged below the base parts 72A and 72B that is opposed to the staple heads 71A and 71B (the stacker tray 80 side). Further, the paper sheet supporting member 200 is provided on an arm 201. The paper sheet supporting member 200 is provided with a paper sheet holding portion 202 that holds a paper sheet bundle P, a rotation axis 203 that attaches the arm 201 to the staple heads 71A and 71B so as to be freely shakable, a spring 204 that works so as to push the arm 201 out of the staple heads 71A and 71B with the rotation axis 203 as the center, and a roll 205 that is supported so as to be rotatable.

As shown in FIG. 14A, when the staple heads 71A and 71B are set at the positions for the saddle-stitching processing, the arm 201 is pushed out of the staple heads 71A and 71B by the spring 204, and the paper sheet holding portion 202 supports the paper sheet bundle P. By this arrangement, loosening of the paper sheet bundle P is restrained, and displacement of the saddle-stitching position is reduced.

On the other hand, as shown in FIG. 14B, when the staple heads 71A and 71B are moved to the home positions, the roll 205 is brought into contact with a sidewall 210 provided on a body frame (not shown in the figure) of the saddle-stitching staple function portion 70. As a result, the arm 201 on which the roll 205 is mounted is rotated to the staple heads 71A and 71B side around the rotation axis 203, and the paper sheet holding portion 202 is moved to the staple heads 71A and 71B side. By this arrangement, the paper sheet supporting member 200 does not interfere with the transporting route of the paper sheet bundle P and does not obstruct the transportation of the paper sheet bundle P to the booklet trays 81A and 81B.

As mentioned above, in the sheet post-processing apparatus 2 of the present exemplary embodiment, after the paper sheet bundle P is saddle-stitched, when the paper sheet bundle P for which the edge stitching is executed is transported or even when the paper sheet P without the stitching processing is transported, in the saddle-stitching staple function portion 70, the staple heads 71A and 71B, the base parts 72A and 72B, and the booklet trays 81A and 81B are moved to the home positions. As a result, each of the edge-stitched paper sheet bundle P, the saddle-stitched paper sheet bundle P and the paper sheet P without the stitching processing is transported on the same transporting route. Therefore, there is no need to constitute separate transporting routes respectively anymore, whereby the size of the sheet post-processing apparatus 2 and the size of the image forming system including the image forming apparatus 1 may be reduced.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A recording medium post-processing apparatus comprising:

a recording-medium collecting member that collects a plurality of recording mediums transported from outside as a recording-medium bundle;

a stitching unit that stitches the recording-medium bundle having:

a supporting portion that supports the recording-medium bundle transported from the recording-medium collecting member; and a stapler portion that pushes a stitching needle into the supported recording-medium bundle; and a recording-medium bundle stacking member that is arranged directly below the stitching unit and stacks the recording-medium bundle stitched by the stitching unit, the supporting portion and the stapler portion of the stitching unit being moved outside a position at one edge portion of the recording-medium bundle when the recording-medium bundle is not stitched.

2. The recording medium post-processing apparatus according to claim 1, wherein the supporting portion and the stapler portion of the stitching unit are held so as to be suspended from above.

3. The recording medium post-processing apparatus according to claim 2, wherein the stitching unit further comprises a holding portion that holds the supporting portion and the stapler portion from above and that moves the supporting portion and the stapler portion outside the position at the one edge portion of the recording-medium bundle.

4. The recording medium post-processing apparatus according to claim 1, wherein the supporting portion includes a tray support on each of a right side and a left side of the recording-medium bundle and the stapler portion includes a staple head on each of the right side and the left side of the recording medium, and the tray support on each of the right side and the left side of the recording-medium bundle and the staple head on each of the right side and the left side of the recording medium are configured to move away from a corresponding edge of the recording-medium bundle in a width direction of the recording-medium bundle.

5. The recording medium post-processing apparatus according to claim 1, wherein the stitching unit further comprises base portions that function as a base when the stitching needle of the stapler portion is pushed and that are arranged on a right side and a left side with respect to a central portion in a width direction of the recording-medium bundle, and the base portions are configured to move away from a corresponding edge of the recording-medium bundle in a width direction of the recording-medium bundle.

6. The recording medium post-processing apparatus according to claim 1, wherein the stapler portion of the stitching unit comprises a recording-medium bundle supporting member that supports the recording-medium bundle, and the recording-medium bundle supporting member is moved in a direction of the stapler portion when the stapler portion is moved outside the position at the one edge portion of the recording-medium bundle.

7. The recording medium post-processing apparatus according to claim 1, wherein the one edge portion of the recording medium is an edge on the longest side of the recording medium.

8. The recording medium post-processing apparatus according to claim 1, wherein the stitching unit stitches a central portion in a width direction of the recording medium bundle.

9. An image forming system comprising:

an image forming apparatus that forms an image on a recording medium; and a recording medium post-processing apparatus that performs post-processing for the recording medium on which the image is formed by the image forming apparatus, the recording medium post-processing apparatus comprising:

a recording-medium collecting member that collects, as a recording-medium bundle, a plurality of recording mediums on which the image is formed and that is transported from the image forming apparatus;

a stitching unit that stitches the recording-medium bundle having:

a supporting portion that supports the recording-medium bundle transported from the recording-medium collecting member; and a stapler portion that pushes a stitching needle into the supported recording-medium bundle; and a recording-medium bundle stacking member that is arranged directly below the stitching unit and stacks the recording-medium bundle stitched by the stitching unit, the supporting portion and the stapler portion of the stitching unit being moved outside a position at one edge portion of the recording-medium bundle when the recording-medium bundle is not stitched.

10. The image forming system according to claim 9, wherein the supporting portion and the stapler portion of the stitching unit are held so as to be suspended from above.

11. The image forming system according to claim 9, wherein the supporting portion includes a tray support on each of a right side and a left side of the recording-medium bundle and the stapler portion includes a staple head on each of the right side and the left side of the recording medium, and the tray support on each of the right side and the left side of the recording-medium bundle and the staple head on each of the right side and the left side of the recording medium are configured to move away from a corresponding edge of the recording-medium bundle in a width direction of the recording-medium bundle.

12. The image forming system according to claim 9, wherein the stapler portion of the stitching unit comprises a recording-medium bundle supporting member that supports the recording-medium bundle, and the recording-medium bundle supporting member is moved in a direction of the stapler portion when the stapler portion is moved outside the position at the one edge portion of the recording-medium bundle.

13. The image forming system according to claim 9, wherein the one edge portion of the recording medium is an edge on the longest side of the recording medium.

14. A post-processing method comprising:

collecting a plurality of recording mediums transported from outside as a recording-medium bundle on a recording-medium collecting member;

moving a supporting portion that supports the recording-medium bundle transported from the recording-medium collecting member and a stapler portion that pushes a stitching needle into the supported recording-medium bundle, from an outside of a position at one edge portion of the recording-medium bundle to the position at the one edge portion of the recording-medium bundle;

transporting the recording-medium bundle to the supporting portion that supports the recording-medium bundle and is suspended from above;

stitching the recording-medium bundle by using the stapler portion that pushes the stitching needle into the recording-medium bundle and is suspended from above the recording medium; and stacking the stitched recording-medium bundle on a recording-medium bundle stacking member, wherein the recording-medium bundle stacking member is disposed directly below the stapler portion.

15. The post-processing method according to claim 14, further comprising moving the supporting portion and the stapler portion to the outside of the position at the one edge portion of the recording-medium bundle after the process of stitching the recording-medium bundle.

16. The post-processing method according to claim 14, wherein the supporting portion and the stapler portion of a stitching unit are held so as to be suspended from above.

* * * * *